US005448348A

United States Patent [19]

Azeta

[11] Patent Number: 5,448,348

[45] Date of Patent: Sep. 5, 1995

[54] IMAGE FORMING APPARATUS HAVING A SHEET MATERIAL TRANSPORT DEVICE

[75] Inventor: Takahiro Azeta, Kawasaki, Japan

[73] Assignee: Canon Kabushiki Kaisha, Tokyo, Japan

[21] Appl. No.: 12,795

[22] Filed: Jan. 28, 1993

Related U.S. Application Data

[63] Continuation of Ser. No. 472,797, Jan. 31, 1990, abandoned.

[30] Foreign Application Priority Data

Feb. 16, 1989 [JP] Japan ..... 1-36920

[51] Int. Cl.[6] ..... G03G 21/00

[52] U.S. Cl. ..... 355/319; 271/65; 271/291; 271/902; 347/218; 355/321

[58] Field of Search ..... 355/318, 319, 321, 308, 355/309; 271/902, 291, 65; 358/498; 346/160.1; 347/215, 217, 218

[56] References Cited

U.S. PATENT DOCUMENTS

| | | | |
|---|---|---|---|
| 4,346,880 | 8/1982 | Roller et al. | 271/225 X |
| 4,348,101 | 9/1982 | Schonfeld et al. | 355/319 |
| 4,692,020 | 9/1987 | Tsujihara | 355/319 |
| 4,699,503 | 10/1987 | Hyltoft | 355/319 |
| 4,708,462 | 11/1987 | Stemmle | 355/319 X |
| 4,734,738 | 3/1988 | Yamanaka et al. | 355/318 |
| 4,750,016 | 6/1988 | Kusumoto et al. | 355/318 X |
| 4,780,745 | 10/1988 | Kodama | 355/319 |
| 4,787,616 | 11/1988 | Sasaki et al. | 271/291 X |
| 4,806,979 | 2/1989 | Tokoro et al. | 355/319 |
| 4,825,245 | 4/1989 | Fukae et al. | 355/319 X |
| 4,875,063 | 10/1989 | Iednawa et al. | 346/160.1 |
| 4,928,127 | 5/1990 | Stemmle | 355/319 X |
| 4,953,846 | 9/1990 | Azeta et al. | 271/902 X |
| 4,990,941 | 2/1991 | Kawai | 355/319 X |
| 5,008,713 | 4/1991 | Ozawa et al. | 355/319 |
| 5,225,881 | 7/1993 | Goto et al. | 355/319 |

FOREIGN PATENT DOCUMENTS

| | | | |
|---|---|---|---|
| 58-111955 | 7/1983 | Japan . | |
| 0186277 | 8/1987 | Japan | 355/319 |
| 0040954 | 2/1989 | Japan | 355/318 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus having a sheet material conveyor includes an image forming unit, a sheet material conveyor on which an image is formed by the image forming unit, a conveying path situated at a downstream side of the conveyor for guiding the sheet material which may be upwardly curved, a paper discharging tray for supporting the sheet material guided through the conveying path, discharging rollers situated at an exit side of the conveying path which can switch between a forward rotation for discharging the sheet material onto the paper discharging tray and a reverse rotation for returning the sheet material in a direction opposite to the direction of discharge, and a reconveying path for accepting the sheet material returned on the conveying path by the reverse rotation of the discharging rollers and for guiding again the sheet material to the image forming unit.

14 Claims, 7 Drawing Sheets

IMAGE FORMING APPARATUS HAVING A SHEET MATERIAL TRANSPORT DEVICE

This application is a continuation of application Ser. No. 07/472,797 filed Jan. 31, 1990, now abandoned.

BACKGROUND OF THE INVENTION

1. Field of the Invention

This invention relates to an image forming apparatus having a sheet material transport device, and more particularly, to an image forming apparatus having a paper reversing mechanism and a reconveying path for duplex copying or printing and multiple copying or printing used for example, in a laser-beam printer, a copier or the like.

2. Description of the Related Art

The configuration of a conventinal image recording apparatus having a paper reversing mechanism will now be explained with reference to the drawings. FIG. 1 shows a paper conveyance path through a copier.

In FIG. 1, there are shown sheets of paper 1 and 1', cassettes 2 and 2', paper-feeding rollers 3 and 3', registration rollers 4 and 4', a photosensitive drum 5, a transfer charger 6, fixing rollers 7 and 7' and conveying rollers 8 and 8' within a fixing unit, a flapper 9, rollers 10 and 10' capable of rotating in forward and reverse directions, conveying rollers 11, 11' and 12, 12', a scanner 13, a turning mirror 14, and paper discharging rollers 15 and 15'.

FIG. 2 is an enlarged detail view of a portion of the paper conveyance path illustrated in FIG. 1.

The paper conveying operation when duplex printing is performed will now be explained.

In FIG. 1, a sheet of paper 1 fed from the cassette 2 by the paper-feeding roller 3 (or from the cassette 2' by the paper-feeding roller 3') is controlled by the registration rollers 4 and 4' so that the front end of the sheet of paper 1 coincides with the front end of an image formed on the photosensitive drum 5 using a known photographic process, and is then conveyed. The image is then transferred to the sheet of paper 1, and the transferred image is fixed by the fixing rollers 7 and 7'. The sheet of paper 1 on which the image is transferred is then guided to the flapper 9 by the conveying rollers 8 and 8'.

Referring to FIG. 2, in the case of performing printing on two surfaces of the sheet of paper 1, the flapper 9 is at a position **9*a* depicted by a solid line when the sheet of paper 1 first passes through the flapper 9**.

The sheet of paper 1 proceeds in the direction A which is the paper conveying route indicated by solid line arrows because of the position of the flapper 9, and is further conveyed by the forward rotation of the rollers 10 and 10' capable of rotating in forward and reverse directions.

When a sensor (not illustrated) detects that the rear end of the sheet of paper 1 has passed a guide plate 16, the rollers 10 and 10' rotate in directions indicated by broken line arrows, and the sheet of paper 1 is conveyed in the reverse direction indicated by broken line arrows.

Referring again to FIG. 1, the sheet of paper 1 subjected to switchback by the rollers 10 and 10' is guided again to registration rollers 4 and 4' along the conveying path indicated by broken line arrows by the conveying rollers 11, 11' and 12, 12'. Printing is then performed on the second surface in the same way as when the first surface was printed. The second printed image on the sheet of paper 1 is also fixed via the fixing rollers 7 and 7', and the sheet of paper 1 with a fixed image on both sides is then guided to the conveying rollers 8 and 8'.

Referring again to FIG. 2, the flapper 9 is controlled so that it is switched to a position **9*b* indicated by a broken line when the sheet of paper 1 on which the second printing has been completed passes through it. The sheet of paper 1 conveyed by the conveying rollers 8 and 8' is directed along conveying path B by the flapper 9, and is discharged outside the apparatus (onto a paper-discharging tray 17) by the paper discharging rollers 15 and 15' which rotate only in one direction, as shown in FIG. 1**.

Although the above-described apparatus has a configuration in which a part of a reversing sheet of paper is sent outside the apparatus, there are apparatuses in which a sheet of paper is reversed only within the apparatus. At that moment, a dedicated space for the reversal is needed.

However, in the conventional apparatus as described above, there are the disadvantages that, since a sheet of paper is subjected to switchback by rollers capable of rotating in forward and reverse directions in a paper reversing mechanism, a space for performing the switchback is newly needed, and hence the size of the apparatus becomes large and the cost becomes high.

SUMMARY OF THE INVENTION

The present invention has been made in consideration of the disadvantages in the conventional apparatus as described above.

It is an object of the present invention to provide a sheet material transfer device in an image forming apparatus in which switchback of a sheet material can be securely and easily performed with a simple configuration.

According to the present invention, an image forming apparatus having means for discharging a printed sheet of paper outside the apparatus and means for mounting the discharged sheet of paper need not newly provide a space for switchback and has a compact configuration, by conveying the sheet of paper by the discharging means, rotating the sheet in the reverse direction before the front end of the sheet is sent onto the mounting means and the rear end of the sheet is detached from the discharging means and returning the sheet again within the apparatus.

Since the image forming apparatus according to the present invention has the configuration as described above, the present invention has the effect that the configuration for reversing a sheet material is simplified.

Furthermore, by providing a path which is different from a path for discharging a sheet material outside the apparatus and by reversing the sheet material on a tray, it becomes possible to provide a paper reversing mechanism with quicker throughput and without loss.

Moreover, by guiding a sheet material nearly straight in a reconveying path, no excessive force is applied on the sheet material at the moment of reversal, and hence little deformation occurs in the sheet material. In the conventional configuration as shown in FIG. 1, since the rear end (the front end at the moment of switchback) of a sheet material is forcibly guided downwardly by a guide, large deformation at the rear-end portion is apt to be large.

In addition, by conveying a sheet material along a curved conveying path, energy is stored in the sheet material. Hence, the rear .end of the sheet material can easily and securely switch the conveying path at the moment of switchback.

DESCRIPTION OF THE PREFERRED EMBODIMENTS

Components of the preferred embodiments which are identical to those shown in the conventional paper conveying unit described before are indicated by like numerals.

Figure 1:
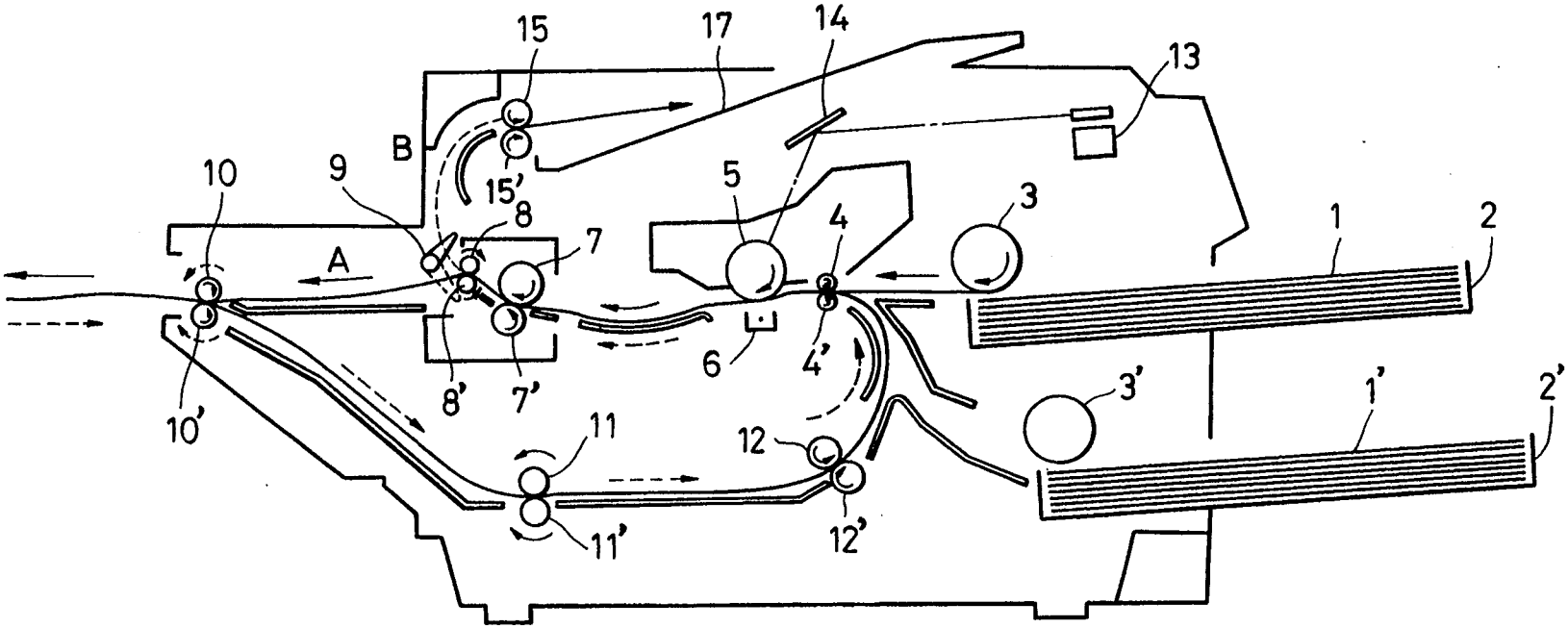
FIG. 1 PRIOR ART
FIG. 1 is a side view of a conventional paper conveying unit having a switchback mechanism.
Figure 2:
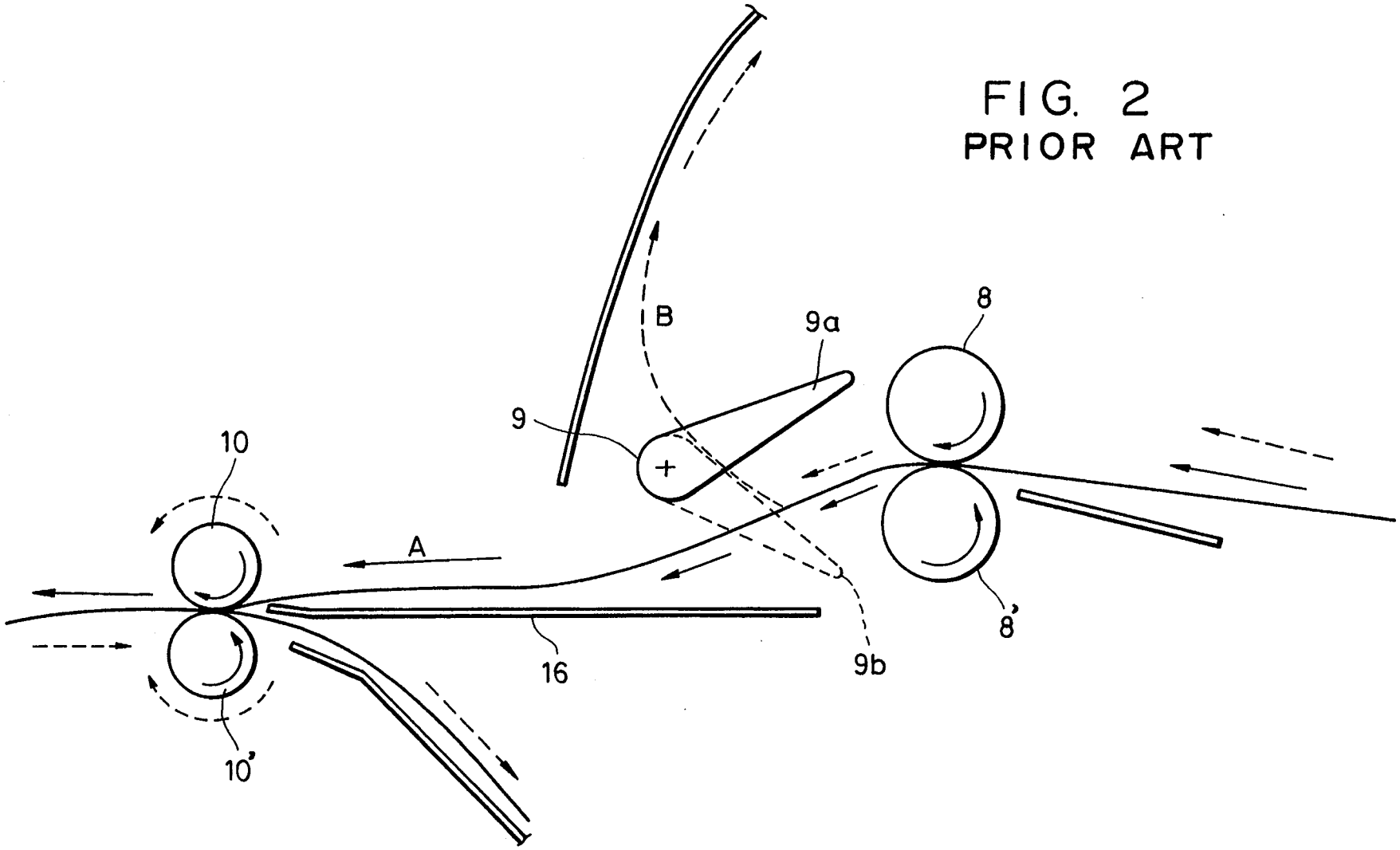
FIG. 2 PRIOR ART
FIG. 2 is a detail view of a switchback unit shown in FIG. 1.
Figure 3:
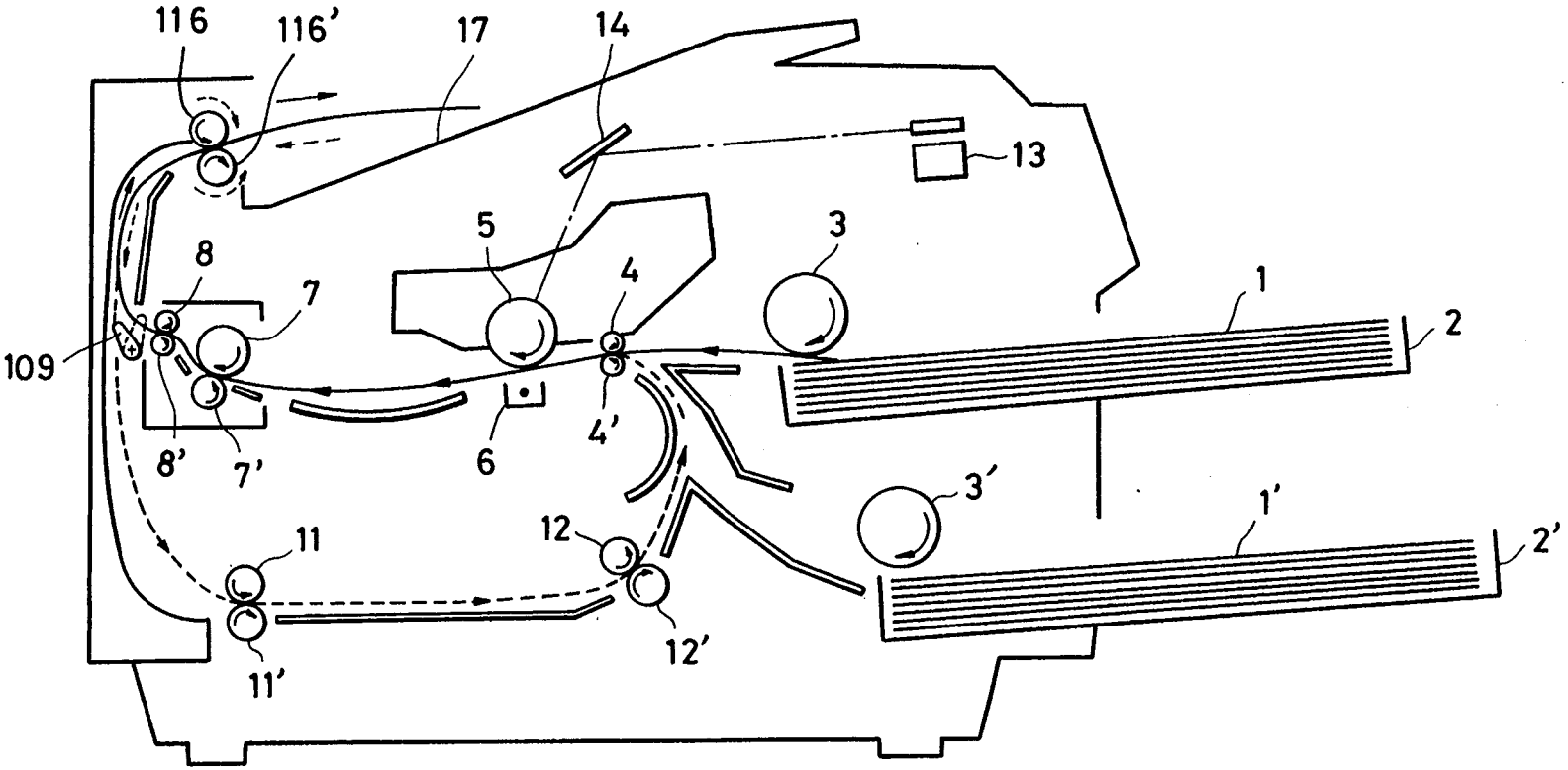
FIG. 3 is a side view of a paper conveying unit according to an embodiment of the present invention.
Figure 4:
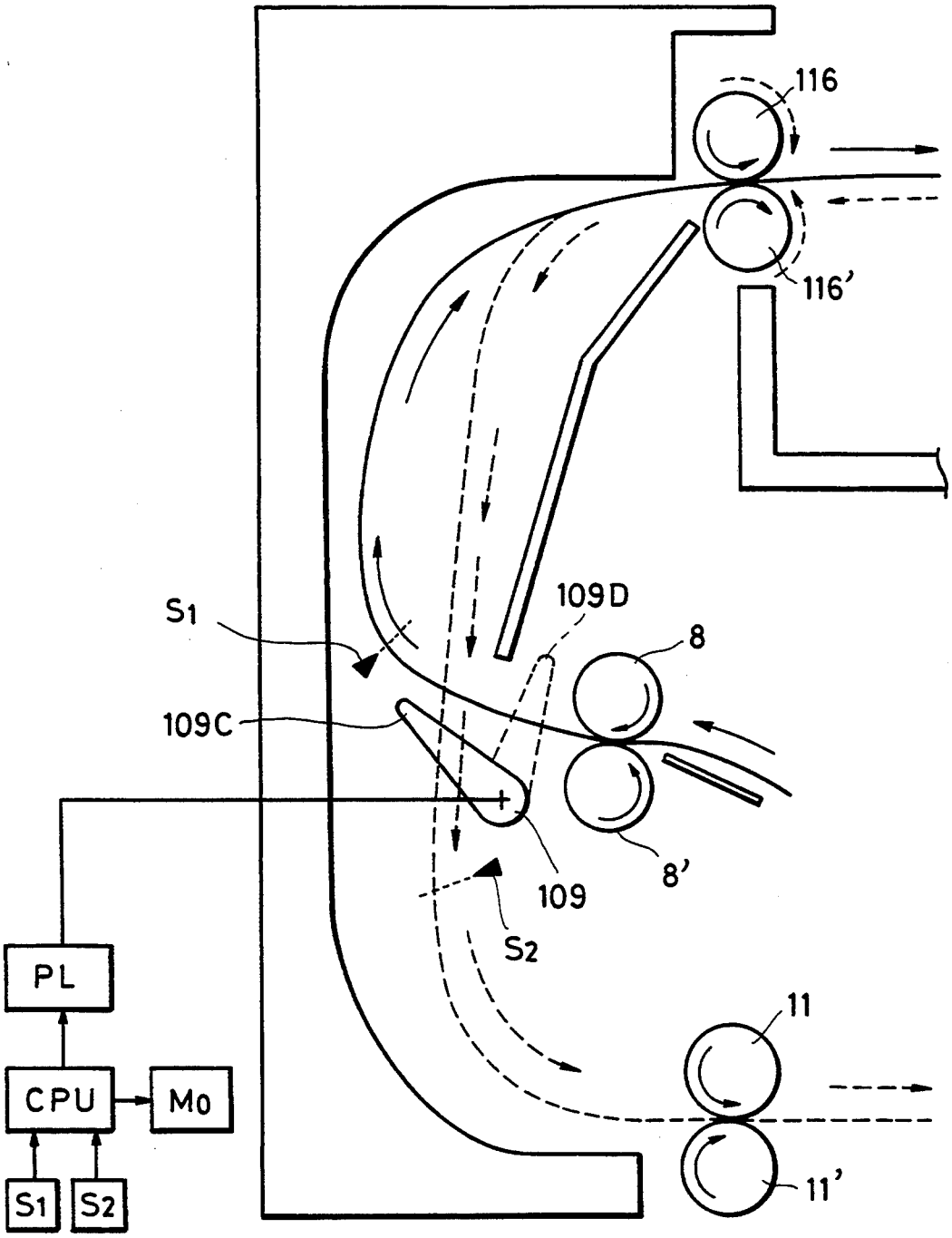
FIG. 4 is a detail view of a switchback unit according to the present embodiment.

As shown in FIGS. 3 and 4, paper discharging rollers 116 and 116' can shift between forward and reverse directions, and the tray 17 is arranged to support discharged sheets of paper.

The paper conveying operation will now be explained.

In the structure illustrated in FIG. 3, printing is performed on one surface of the sheet of paper 1 fed from the cassette 2 via the transfer and fixing process as in the conventional example described before, and the printed sheet of paper 1 is conveyed to the flapper 109.

As shown in FIG. 4, the flapper 109 is usually set at the solid line position 109C. When the sheet of paper 1 is guided to the region of the flapper 109 by the conveying rollers 8 and 8' the sheet of paper 1 proceeds in a direction indicated by solid line arrows by the flapper 109 situated at position 109C, is conveyed to the paper discharging rollers 116 and 116' rotating in the solid line or forward direction, and the front end of the sheet of paper 1 is sent onto the region of the tray 17 for mounting sheets of paper.

When a sensor S1 or the like detects that the rear end of the sheet of paper 1 has passed through the flapper 109, the flapper 109 is switched to the broken line position 109D, and the paper discharging rollers 116 and 116' then rotate in the broken line or reverse direction (although a mechanism for the reverse rotation is omitted, it is possible to perform the reverse rotation by rotating a discharge roller drive motor M0 in the reverse direction). When the paper discharging rollers 116 and 116' rotate in the reverse direction, the sheet of paper 1 is reversely conveyed in a direction shown by broken line arrows, and is conveyed to the conveying rollers 11 and 11' by reason of the flapper 109 being situated at the position 109D. When the rear end of the sheet of paper 1 has passed through the flapper 109 (as detected by a sensor S2), the flapper 109 is returned again to the position 109C.

Referring again to FIG. 3, the sheet of paper 1 conveyed to the conveying rollers 11 and 11' further proceeds to the rollers 12 and 12', and is guided again to the registration rollers 4 and 4'. Printing is then performed on the second surface in the same manner as in the case of printing on the first surface, and the sheet of paper 1 is fixed via the fixing rollers 7 and 7'. The sheet of paper 1 is then conveyed to the conveying rollers 8 and 8', and is futher conveyed to the paper discharging rollers 116 and 116' by reason of the flapper 109 being situated at the position 109C. The sheet of paper 1 on two surfaces of which printing has been completed is then discharged outside the apparatus by the forward rotation of the paper discharging rollers 116 and 116'.

According to the configuration as described above, it is possible to perform switchback of a sheet of paper with a compact structural configuration by performing the switchback in the region of the tray 17 by rotating paper discharging rollers 116 and 116' in forward and reverse directions. Hence, automatic printing on two surfaces becomes possible, while the cost is reduced.

When printing is performed only on one surface, the paper discharging rollers rotate only in the forward direction, and a printed sheet of paper is discharged outside the apparatus.

Figure 5:
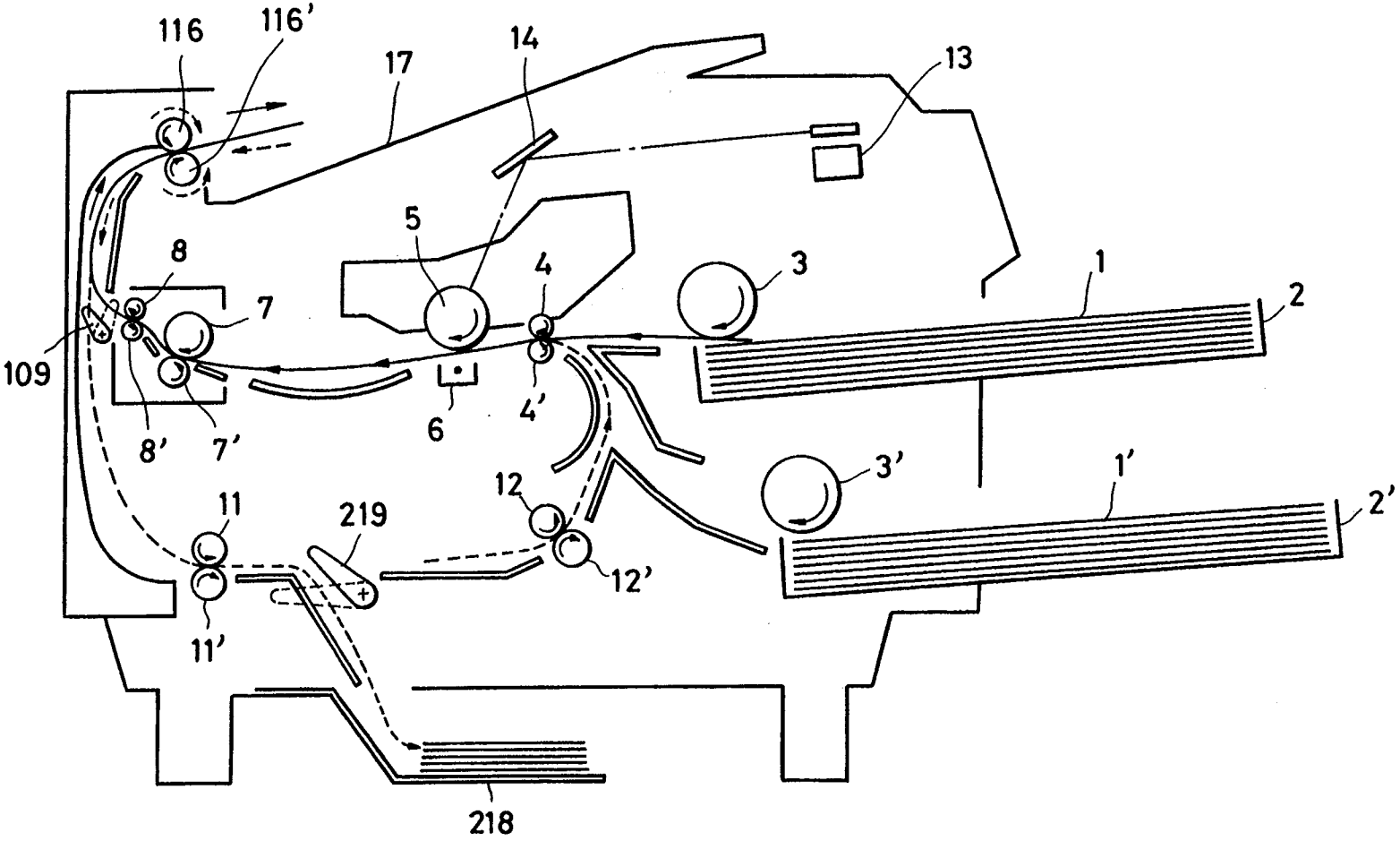
FIG. 5 is a side view of a paper conveying unit according to another embodiment of the present invention.

FIG. 5 is a side view showing a paper conveying path in an image forming apparatus having sheet supporting means 17 and 218 for supporting paper sheets.

A flapper 219 switches between duplex and single surface imaging paths to tray 218.

In the single surface cases, a sheet of paper which has completed a known series of paper conveying operations consisting of transfer, separated conveyance and fixing processes, is directed to the paper discharging rollers 116 and 116' by the flapper 109, is subjected to switchback in the region of the tray 17 to return again into the apparatus, and is directed to the conveying rollers 11 and 11' by the flapper 109 situated at the broken line position.

With the sheet of paper mounted in a faceup state, the flapper 219 is switched to the solid line position, and the sheet is directed to the tray 218 with the image surface face up, i.e. reversed from the state it would have been in tray 17 had it not been switched back. That is, the tray 17 would have supported the sheet in a facedown state, and the tray 218 supports the sheet in a faceup state. When the sheet is conveyed for imaging on two surfaces, the sheet is guided to the rollers 12 and 12' by switching the flapper 219 to the broken line position.

Figure 6:
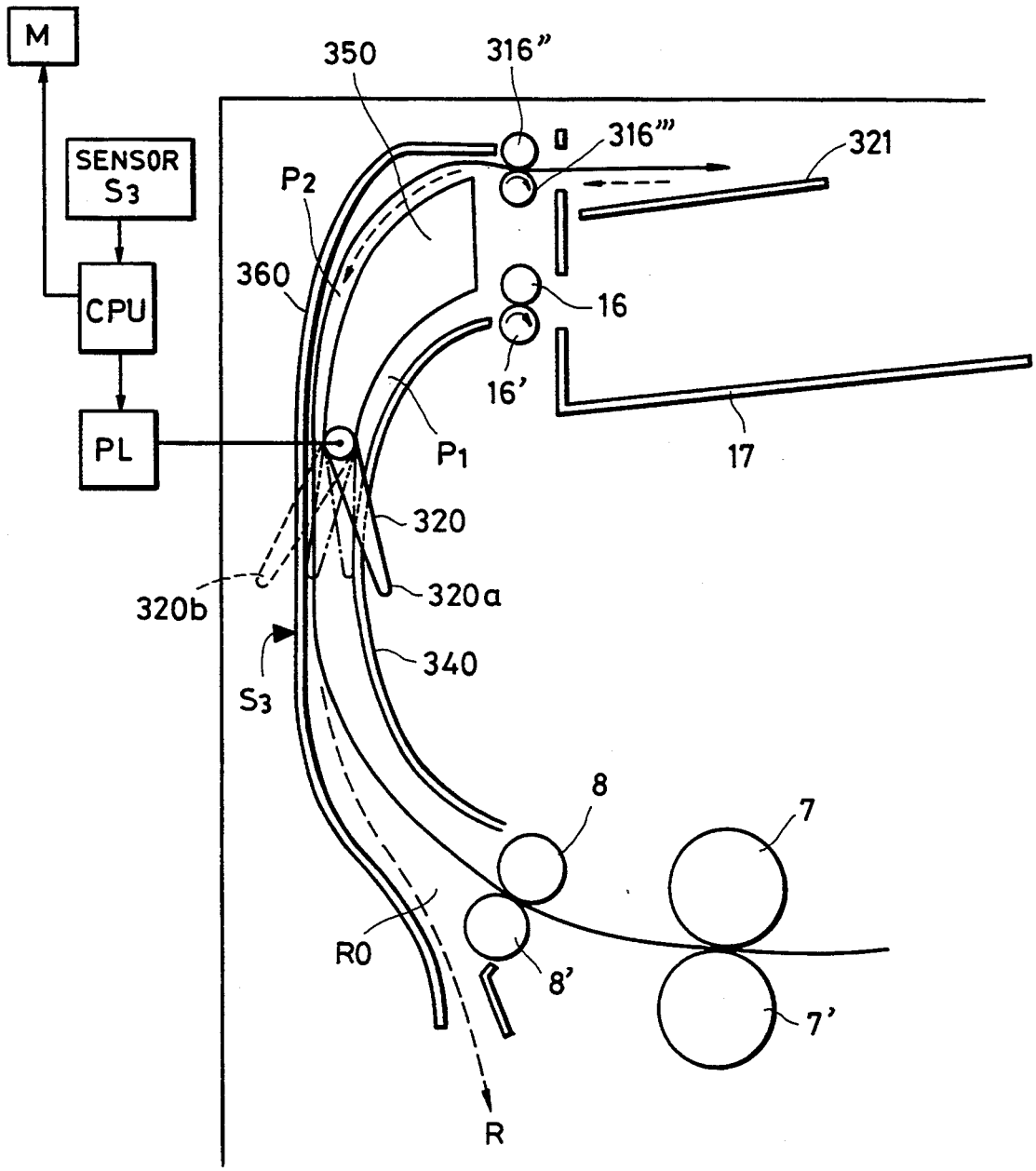
FIG. 6 is a side view of a paper conveying unit according to still another embodiment of the present invention.

Also in the case of image transfer on two surfaces, the sheet can be selectively supported on the tray 17 or on the tray 218 by switching the flapper 109 after image transfer on two surfaces has been completed FIG. 6 shows a paper reversing path in an image forming apparatus having a path P2 which is different from a path P1 for discharging a sheet of paper. The conveying path P1 is formed by guides 340 and 350, and the conveying path P2 is formed by the guide 350 and a guide 360. Rollers 316'' and 316''' capable of rotating in forward and reverse directions can reverse a sheet of paper. A switching flapper 320 may be positioned to direct a sheet of paper to paper discharging rollers 16, 16' or rollers 316'' and 316'''. The rollers 16 and 16' and 316'' and 316''' may conveniently be vertically aligned with rollers 316'' and 316''' above rollers 16 and 16'. As described before, the sheet fixed at the fixing rollers 7 and 7', after the completion of the transfer, is guided to the flapper 320 by the conveying rollers 8 and 8'. At this moment, the flapper 320 is situated in the solid line position **320*a*. The sheet is thus directed to the rollers 316'' and 316''' which are now rotating in the forward direction. The sheet is then reversed on a parting plate 321 on the tray 17 by reversing the direction of rotation of the rollers 316'' and 316''' before the rear end of the sheet is detached from the rollers. The reverse rotation of the rollers 316'' and 316'''** is performed by reversing rotation of a motor M.

The reversed sheet is conveyed in the reverse direction as shown by broken line arrows, that is, in the path R for performing image transfer on its second surface, and is conveyed along a reconveying path in the same manner as described above.

Figure 7:
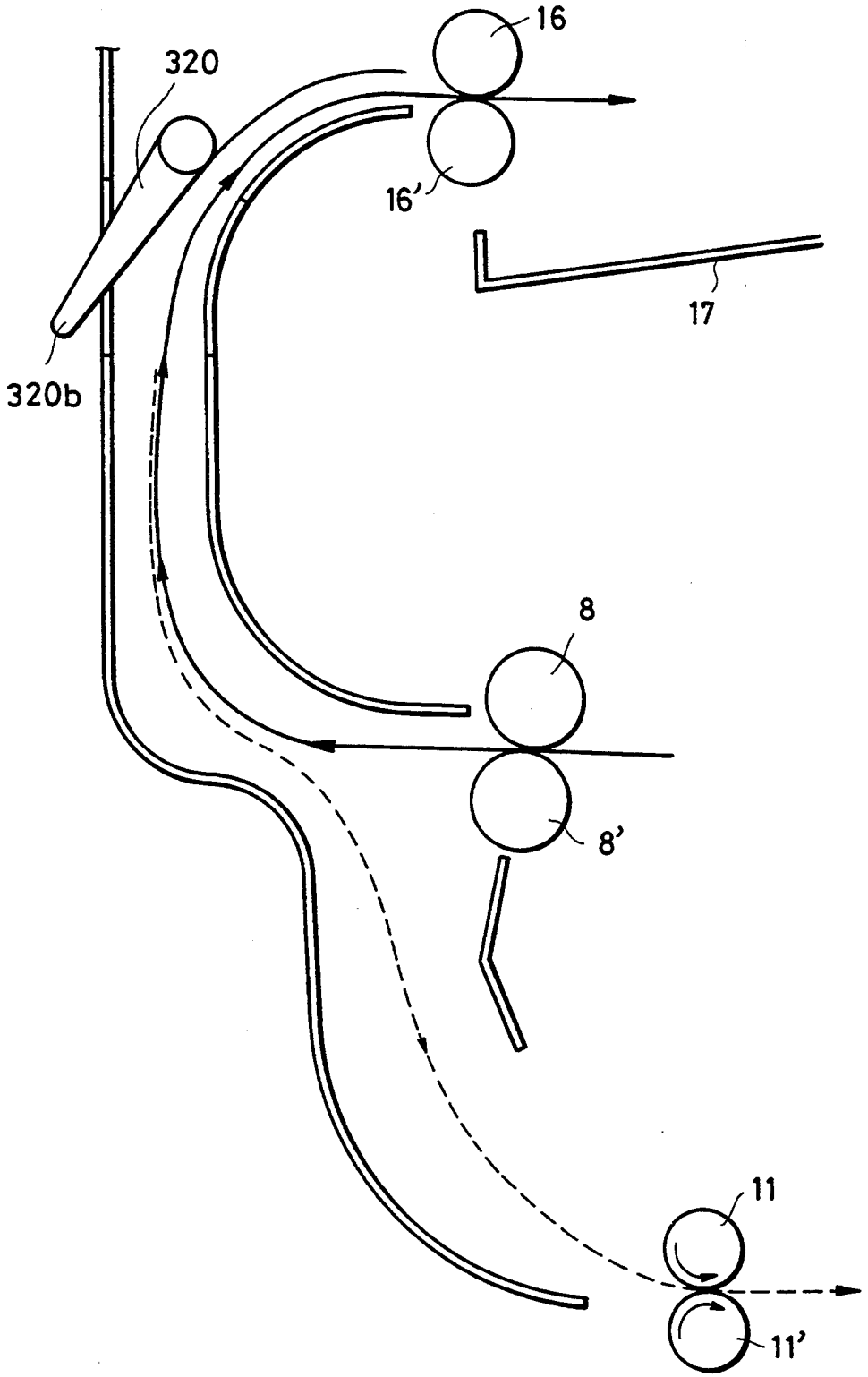
FIG. 7 is a detail view of the paper conveying unit shown in FIG. 6.

In this case, when the sheet has fully passed through the flapper 320, the flapper 320 is switched to its broken line position 320*b*, and it is possible to discharge a preceding sheet on which imaging has already been performed onto the tray 17 by the discharging rollers 16 and 16' while physically encoutering the reversed sheet, as shown in FIG. 7. The flapper 320 is pivoted back and forth by a rotary plunger PL, the timing for the pivoting movement being controlled by a CPU. As an input to the CPU, a sensor S3 is provided for detecting the rear end of a sheet. As described above, by providing a path which is different from the path for discharging a sheet of paper outside the apparatus and reversing the sheet on the tray 17, it becomes possible to provide a paper: reversing mechanism without newly providing a space for switchback and, in addition, with a quick throughput without loss. This approach is more effective as the distance between the flapper 320 and the rollers 8, 8' is increased.

As explained above, according to these embodiments of the present invention, by conveying a sheet material by the discharging rollers for discharging the sheet material outside the apparatus, and performing automatic printing on two surfaces by performing switchback of the sheet material, it is possible to provide a compact configuration without requiring additional space for performing the switchback of the sheet material, and a simple and stable reversing unit is achieved. Furthermore, no new process or apparatus for dealing with jamming is newly required. Even if a sheet material is jammed at the reversing unit, the user of the apparatus can remove the sheet material from a front portion where there is a cassette.

Moreover, as a modified example of the unit shown in FIG. 6, it is also possible to discharge a sheet material onto the tray 17 while the sheet material encounters a preceding sheet material by switching the flapper 320 to a position depicted by a two dot chain line while the sheet material is reversely conveyed in the .conveying path P2.

Furthermore, the preceding sheet material may be discharged onto the tray 17 by switching the flapper 320 to its broken line position while the rear end of the sheet material being conveyed by the forward rotation of the rollers 316'' and 316''' passes through the flapper 320. After the preceding sheet material has been discharged onto the tray 17 (or after it has passed through the flapper 320), the flapper 320 is switched to its solid line position, and the rollers 316'' and 316''' are rotated in the reverse direction.

In addition, in the above-described case, the flapper 320 may be switched to the position depicted by the single dot chain line after the front end of the preceding sheet material has passed through the flapper 320.

What is claimed is:

1. An image forming apparatus having sheet material transport means comprising:

image forming means;

means for conveying a sheet material on which an image is formed by said image forming means;

an upwardly curving conveying path situated at a downstream side of said conveying means for guiding the sheet material;

paper discharging tray means for supporting the sheet material guided through said conveying path, said paper discharging tray means situated atop of said apparatus;

discharging means comprising a pair of discharge rollers situated at an exit side of said conveying path opposite and immediately adjacent to said paper discharging tray means and which can shift between a first mode for discharging the sheet material onto said paper discharging tray means and a second mode for returning the sheet material to said conveying path in a direction opposite to the direction of discharge;

a reconveying path for accepting the sheet material returned to said conveying path by said discharge means in its second mode for guiding again the sheet material to said image forming means, said reconveying path positioned below said conveying means; and flapper means for switching between a position for guiding the sheet material conveyed by said conveying means to the conveying path and a position for guiding the sheet material being returned on the conveying path to said reconveying path.

2. An image forming apparatus having a sheet material conveyor according to claim 1, wherein the discharge means first conveys the leading edge of the sheet into the inner part of the tray while in the second mode and the reconveying path accepts the sheet returned to it while said sheet is substantially straight.

3. An image forming apparatus having a sheet material conveyor comprising:

image forming means;

means for conveying a sheet material on which an image is formed by said image forming means;

an upwardly curving conveying path situated at a downstream side of said conveying means for guiding the sheet material;

first paper discharging tray means for supporting the sheet material guided through said conveying path, said first paper discharging tray means situated atop of said apparatus;

discharge means situated at an exit side of said conveying path and which can shift between a first mode for discharging the sheet material onto said first paper discharging tray means and a second mode for returning the sheet material to said conveying path in a direction opposite to the direction of discharge;

a reconveying path for accepting the sheet material returned to said conveying path by said discharge means in its second mode for guiding again the sheet material to said image forming means, said reconveying path positioned below said conveying means; and second paper discharging tray means, positioned below said reconveying path, for supporting the sheet material such that the sheet material is externally accessible, wherein a flapper is provided within said reconveying path so that the sheet material can be directed to said second paper discharging tray means, wherein the sheet material supported by said first paper discharging tray means and the sheet material supported by said second paper discharging tray means are supported after having an image formed on at least one side by said image forming means.

4. An image forming apparatus having a sheet material conveyor comprising:

image forming means;

means for conveying a sheet material on which an image is formed by said image forming means;

a first conveying path situated at a downstream side of said conveying means for guiding the sheet material;

paper discharging tray means for supporting the sheet material;

first rotating discharge means situated at an exit side of said first conveying path for discharging the sheet material onto a first part of said paper discharging tray means;

a second conveying path provided along said first conveying path for guiding the sheet material;

second rotating discharge means situated at an exit side of said second conveying path opposite and immediately adjacent to said paper discharging tray means and capable of performing forward and reverse rotations and guiding the leading edge of the sheet material onto a second part of said paper discharging tray means;

flapper means capable of being switched so that the sheet material is directed to said first conveying path or to said second conveying path; and a reconveying path for accepting the sheet material returned to said second conveying path by the reverse rotation of said second rotating discharge means and for guiding again the sheet material to said image forming means.

5. An image forming apparatus having a sheet material conveyor according to claim 4, wherein the first and second conveying paths are upwardly curved, and wherein the reconveying path accepts the sheet material returned on said second conveying path nearly straight.

6. An image forming apparatus having a sheet material conveyor according to claim 4, wherein the first and second conveying paths are commonly formed utilizing a part of a guide plate.

7. An image forming apparatus having a sheet material conveyor according to claim 6, wherein the first and second rotating discharge means are vertically aligned and the second rotating discharge means is situated above the first rotating discharge means.

8. An image forming apparatus having a sheet material conveyor according to claim 4, wherein a preceding sheet material encounters a succeeding sheet material when the preceding sheet is sent to the second conveying path by the reverse rotation of said second rotating discharge means.

9. An image forming apparatus having a sheet material conveyor according to claim 4, wherein said paper discharge tray means is situated atop the apparatus and said first and second conveying paths are curved upward.

10. An image forming apparatus having a sheet material conveyor according to claim 9, wherein the reconveying path accepts the sheet material on said second conveying path nearly straight.

11. An image forming apparatus having a sheet material conveyor comprising:

image forming means;

means for conveying a sheet material on which an image is formed by said image forming means;

a first conveying path situated at a downstream side of said conveying means for guiding the sheet material;, paper discharging tray means for supporting the sheet material;

first rotating discharge means situated at an exit side of said first conveying path for discharging the sheet material onto a first part of said paper discharging tray means;

a second conveying path provided along said first conveying path for guiding the sheet material;

second rotating discharge means situated at an exit side of said second conveying path and capable of performing forward and reverse rotations and guiding the leading edge of the sheet material onto a second part of said paper discharging tray means;

flapper means capable of being switched so that the sheet material is directed to said first conveying path or to said second conveying path; and a reconveying path for accepting the sheet material returned to said second conveying path by the reverse rotation of said second rotating discharge means and for guiding again the sheet material to said image forming means, wherein said first and second conveying paths are commonly formed utilizing a part of a guide plate, wherein said first and second rotating discharge means are vertically aligned and said second rotating discharge means is situated above said first rotating discharge means, wherein said paper discharging tray means includes sheet material parting means corresponding to said second rotating discharge means.

12. An image forming apparatus having sheet material transport means comprising:

image forming means;

means for conveying a sheet material on which an image is formed by said image forming means;

an upwardly curving conveying path situated at a downstream side of said conveying means for guiding the sheet material;

paper discharging tray means for supporting the sheet material guided through said conveying path, said paper discharging tray means situated atop of said apparatus;

discharge means comprising a pair of discharge rollers situated at an exit side of said conveying path opposite and immediately adjacent to said paper discharging tray means and which can shift between a first mode for discharging the sheet material onto said paper discharging tray means and a second mode for first conveying the leading edge of the sheet into an inner part of said paper discharging tray means and then returning the sheet material to said conveying path in a direction opposite to the direction of discharge;

a reconveying path for accepting the sheet material returned to said conveying path by said discharge means in its second mode while the sheet material is substantially straight for guiding again the sheet material to said image forming means; and flapper means for switching between a position for guiding the sheet material conveyed by said conveying means to the conveying path and a position for guiding the sheet material being returned on the conveying path to said reconveying path.

13. An image forming apparatus having a sheet material conveyor comprising:

image forming means;

means for conveying a sheet material on which an image is formed by said image forming means;

a first conveying path situated at a downstream side of said conveying means for guiding the sheet material;

first paper discharging tray means for supporting the sheet material guided through said first conveying path;

first rotating discharge means situated at an exit side of said first conveying path for discharging the sheet material onto said first paper discharging tray means;

a second conveying path provided along said first conveying path for guiding the sheet material;

second rotating discharge means situated at an exit side of said second conveying path and capable of performing forward and reverse rotations;

first flapper means capable of being switched so that the sheet material is directed to said first conveying path or to said second conveying path;

a reconveying path for accepting the sheet material returned to said second conveying path by the reverse rotation of said second rotating discharge means and for guiding again the sheet material to said image forming means;

second paper discharging tray means, positioned below said reconveying path, for supporting the sheet material such that the sheet material is externally accessible; and second flapper means provided within said reconveying path so that the sheet material can be directed to said second paper discharging tray means, wherein the sheet material supported by said first paper discharging tray means and the sheet material supported by said second paper discharging tray means are supported after having an image formed on at least one side by said image forming means.

14. An image forming apparatus having sheet material transport means comprising:

image forming means;

means for conveying a sheet material on which an image is formed by said image forming means;

a conveying path situated at a downstream side of said conveying means for guiding the sheet material;

first paper discharging tray means for supporting the sheet material guided through said conveying path;

discharge means situated at an exit side of said conveying path and which can shift between a first mode for discharging the sheet material onto said first paper discharging tray means and a second mode for returning the sheet material to said conveying path in a direction opposite to the direction of discharge;

a reconveying path for accepting the sheet material returned to said conveying path by said discharge means in its second mode for guiding again the sheet material to said image forming means;

second paper discharging tray means, positioned below said reconveying path, for supporting the sheet material such that the sheet material is externally accessible; and a flapper provided within said reconveying path so that the sheet material can be directed to said second paper discharging tray means, wherein the sheet material supported by said first paper discharging tray means and the sheet material supported by said second paper discharging tray means are supported after having an image formed on at least one side by said image forming means.

* * * * *

UNITED STATES PATENT AND TRADEMARK OFFICE

CERTIFICATE OF CORRECTION

PATENT NO. : 5,448,348
DATED : September 5, 1995
INVENTOR(S) : TAKAHIRO AZETA

It is certified that error appears in the above-indentified patent and that said Letters Patent is hereby corrected as shown below:

COLUMN 3

Line 56, "motor MO" should read --motor Mo--.

COLUMN 6

Line 31, "a" should be deleted; and "conveyor" should read --transport means--.

Signed and Sealed this

Twenty-sixth Day of December, 1995

*Attest:*

Bruce Lehman

BRUCE LEHMAN

*Attesting Officer*

*Commissioner of Patents and Trademarks*